US007865337B2

(12) United States Patent
Hammerschmidt

(10) Patent No.: US 7,865,337 B2
(45) Date of Patent: Jan. 4, 2011

(54) METHOD AND APPARATUS FOR READING OUT AN ANALOG SENSOR OUTPUT SIGNAL

(75) Inventor: Dirk Hammerschmidt, Villach (AT)

(73) Assignee: Infineon Technologies AG, Neubiberg (DE)

( * ) Notice: Subject to any disclaimer, the term of this patent is extended or adjusted under 35 U.S.C. 154(b) by 461 days.

(21) Appl. No.: 11/952,842

(22) Filed: Dec. 7, 2007

(65) Prior Publication Data

US 2008/0136666 A1 Jun. 12, 2008

(30) Foreign Application Priority Data

Dec. 8, 2006 (DE) ..... 10 2006 058 011

(51) Int. Cl.
*H04B 15/00* (2006.01)

(52) U.S. Cl. ..... 702/189; 702/57; 702/124; 702/190; 702/197; 381/71.2; 375/295; 348/222.1; 340/870.02

(58) Field of Classification Search ..... 702/57, 702/124, 189, 190, 197; 381/71.2; 375/295; 348/222.1; 340/153.7, 870.02
See application file for complete search history.

(56) References Cited

U.S. PATENT DOCUMENTS

| | | | | |
|---|---|---|---|---|
| 3,568,063 | A * | 3/1971 | Brown | 375/245 |
| 4,989,219 | A * | 1/1991 | Gerdes et al. | 375/286 |
| 5,440,939 | A | 8/1995 | Barny et al. | |
| 5,459,432 | A | 10/1995 | White et al. | |
| 6,023,960 | A | 2/2000 | Abrams et al. | |
| 6,386,032 | B1 | 5/2002 | Lemkin et al. | |
| 7,046,177 | B2 | 5/2006 | Immink et al. | |
| 7,310,382 | B2 * | 12/2007 | Fonden et al. | 375/297 |
| 7,327,296 | B1 * | 2/2008 | Gaboriau et al. | 341/143 |
| 7,420,152 | B2 * | 9/2008 | Burkatovsky | 250/214 AG |

FOREIGN PATENT DOCUMENTS

| | | | |
|---|---|---|---|
| DE | 693 11 831 | T2 | 10/1997 |
| DE | 10 2005 046 699 | B4 | 9/2007 |
| EP | 0 565 462 | A1 | 4/1993 |
| WO | WO 2004/070951 | A2 | 8/2004 |
| WO | WO 2007/036224 | A1 | 4/2007 |

OTHER PUBLICATIONS

Lemkin, M., et al., "A three-axis micromachined accelerometer with a CMOS position-sense interface and digital offset-trim electronics," IEEE Journal of Solid-State Circuits, vol. 34, Issue: 4, Apr. 1999, pp. 456-468, IEEE.

Kawahito, S., et al., "A weak magnetic field measurement system using micro-fluxgate sensors and delta-sigma interface," IEEE Transactions on Instrumentation and Measurement, vol. 52, Issue: 1, Feb. 2003, pp. 103-110, IEEE.

* cited by examiner

*Primary Examiner*—Mohamed Charioui
*Assistant Examiner*—Elias Desta
(74) *Attorney, Agent, or Firm*—Slater & Matsil, L.L.P.

(57) ABSTRACT

An apparatus for reading out a modulated time-continuous sensor output signal includes a loop filter, a sample-quantizer and a feedback circuit. The loop filter filters the sensor output signal to provide a filtered sensor output signal, and amplifies frequency proportions present in a frequency range. The sample-quantizer samples and quantizes the filtered sensor output signal to provide a time-discrete, quantized sensor output signal. The feedback circuit feeds a feedback signal based on the time-discrete, quantized sensor output signal back to the loop filter and provides a readout signal.

47 Claims, 4 Drawing Sheets

METHOD AND APPARATUS FOR READING OUT AN ANALOG SENSOR OUTPUT SIGNAL

This application claims priority from German Patent Application No. 10 2006 058 011.7, which was filed on Dec. 8, 2006, and is incorporated herein in its entirety by reference.

TECHNICAL FIELD

Embodiments of the present invention relate to a concept for reading out and rendering a sensor output signal of a sensor, and in particular to a concept for continuously reading out a time and value-continuous (analog) sensor output signal of a sensor, such as a capacitive sensor, modulated with a fundamental frequency.

BACKGROUND

In general, sensors are based on the principle that changes of electrical parameters of a device by an external influence, such as the measured quantity to be sensed, are sensed and evaluated. Thus, in a capacitive pressure sensor, the capacitance of a capacitor element changes when a capacitor plate of the sensor element formed as a membrane is deflected as a result of changing ambient pressure. A measurement circuit accordingly measures the change of the electrical parameters as a capacitance change of the capacitor and converts this electrical parameter into an analog output signal or a digital value. The output signal or digital value thus obtained are then transferred to a processing means via a signal path and evaluated by the same, in order to finally obtain an indication of the measured quantity to be sensed.

A conventional technique for reading out capacitive sensors (sensor capacitances) consists in the so-called switched capacitor (SC) technique, for example. Here, a reference voltage is sampled with a sensor capacitance, and the change in charge proportional to the capacitance change or the resulting current flow is processed further. Since the resulting sensor signal usually is to be digitized, a so-called delta/sigma modulator is frequently used as a further processing circuit.

A disadvantage of the known switched capacitor technique consists in the sampling of the white noise in the sensor output signal, which develops, for example, when reading out capacitive sensors by the so-called ON resistances (turn-on or pass resistances) of the switches used in the switched capacitor technique. Through the ON resistances of the switches used, a noise charge proportional to the factor k*T*C develops on the sensor capacitor, wherein k represents the Boltzmann constant, T the absolute temperature, and C the capacitance of the sensor. This sampled white noise in the sensor output signal will be referred to as so-called sampling noise in the following. Since the above capacitance value C is the overall capacitance of the capacitive sensor (sensor capacitor) and this overall capacitance often is substantially greater than the capacitance change, which generates the sensor output signal, by the measurement effect used by the sensor, this sampled white noise often leads to a limitation of the resolution of the measurement signal that can be reached in readouts in the switched capacitor technique.

SUMMARY OF THE INVENTION

According to embodiments of the present invention, an apparatus for reading out a time-continuous sensor output signal of a sensor, modulated with a fundamental frequency, has a loop filter, a sample-quantizer and a feedback means.

The loop filter filters the sensor output signal to provide a filtered sensor output signal in which frequency proportions present in a frequency range $\Delta f$ with respect to the fundamental frequency $f_0$ are amplified. The sample-quantizer samples and quantizes the filtered sensor output signal to provide a time-discrete, quantized sensor output signal. The feedback means or circuit or arrangement feeds a feedback signal based on the time-discrete, quantized sensor output signal back to the loop filter and provides a readout signal, wherein the readout signal corresponds to the time-discrete, quantized sensor output signal or the time-discrete, quantized sensor output signal demodulated with respect to the fundamental frequency $f_0$.

BRIEF DESCRIPTION OF THE DRAWINGS

Embodiments of the present invention will be detailed subsequently referring to the appended drawings, in which.

Figure 1:
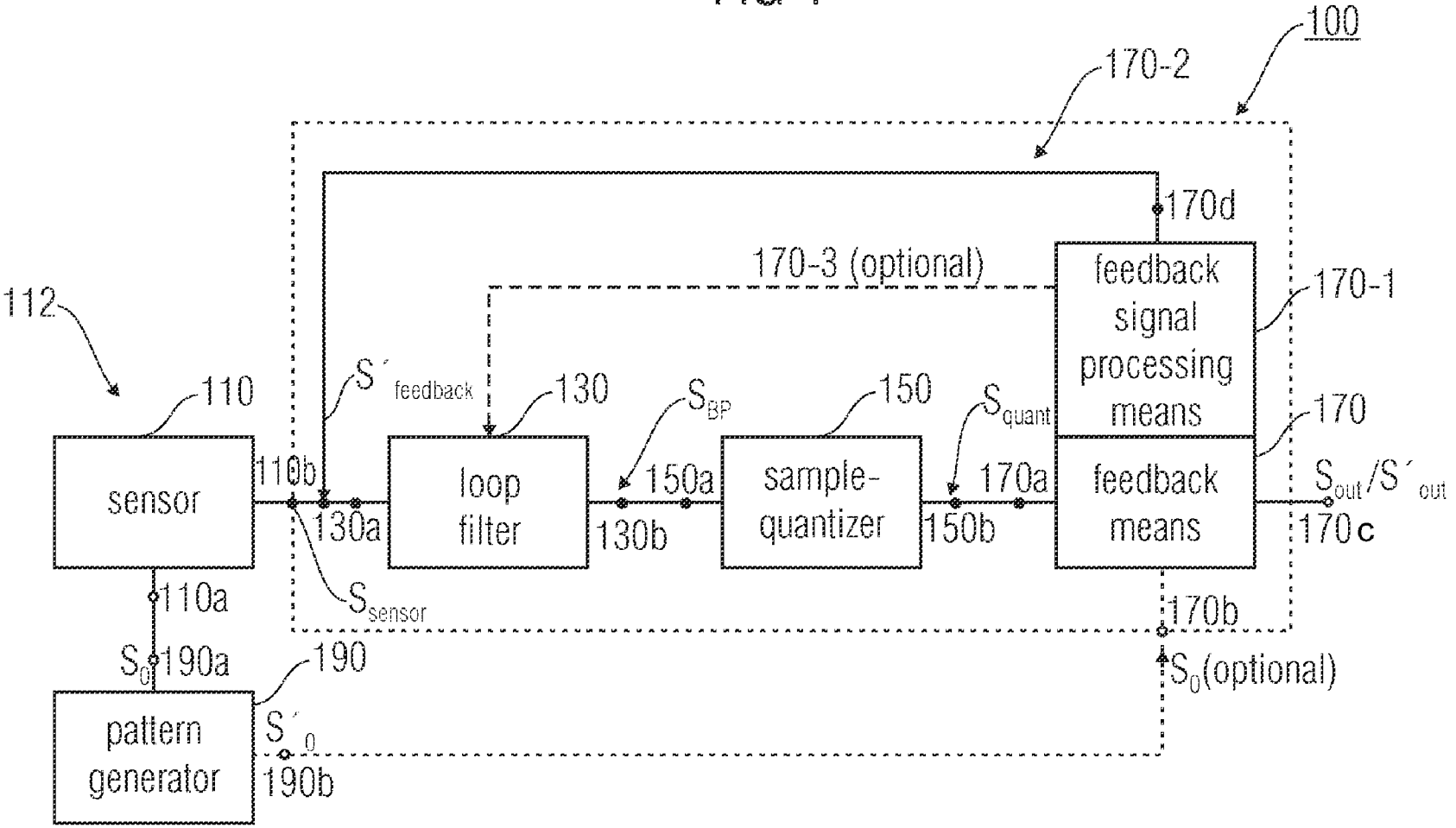
FIG. 1 is a principle block diagram of a readout apparatus according to an embodiment of the present invention.

Before explaining the embodiments of the present invention in greater detail in the following on the basis of the drawings, it is pointed out that the same, similarly acting or functionally the same elements in the various figures advantageously are provided with the same reference numerals, so that the descriptions of these elements are mutually interchangeable in the various, subsequent embodiments.

DETAILED DESCRIPTION OF ILLUSTRATIVE EMBODIMENTS

According to embodiments of the present invention, a continuous readout process of a time and value-continuous (analog) sensor output signal of a capacitive sensor is performed, avoiding the undesired sampling noise, so that the sampling necessary for the analog/digital conversion is shifted to the end of a loop filter of a delta/sigma modulator in the signal processing chain, i.e., between the loop filter and the quantizer. Thereby, a time-continuously working band-pass delta/sigma modulation of a sensor output signal for capacitive sensors is realized. According to an embodiment of the invention, the undesired sampling noise is not caused here until a point in the readout of the sensor output signal at which the sampling noise corresponding to the quantization noise can be shifted into frequency ranges outside the relevant signal range, i.e., outside the fundamental frequency $f_0$ (stimulation frequency) of the modulated, analog sensor output signal, by the noise shaping function of the delta/sigma modulator loop.

FIG. 1 shows a readout apparatus 100 for a time-continuous sensor output signal $S_{sensor}$ of a sensor 110, modulated with a fundamental frequency $f_0$, and particularly of a capacitive sensor 110 comprising an input terminal 110*a* and an output terminal 110*b*. The inventive readout apparatus 100 includes a loop filter 130, which is advantageously formed as a one or multi-stage band-pass filter, with an input terminal 130*a* and an output terminal 130*b*, a sample-quantizer 150 with an input terminal 150*a* and an output terminal 150*b*, and a feedback means 170 with a first input terminal 170*a*, an (optional) second input terminal 170*b*, a first output terminal 170*c*, and a second output terminal 170*d*. The feedback means 170, for example, comprises an associated feedback signal processing means 170-1 for processing and providing the feedback signal $S_{feedback}$ and an accompanying feedback branch 170-2. The feedback means 170 with the associated feedback signal processing means 170-1 and the associated feedback branch 170-2 generally will be referred to as feedback path or feedback loop in the following.

Furthermore, an (optional) signal generator 190 (pattern generator) with a first output terminal 190*a* and a second output terminal 190*b* for providing an (analog) stimulation signal $S_0$ at the fundamental frequency $f_0$ is illustrated in FIG. 1.

It is to be noted that the signal generator 190 is not a necessary component of the inventive readout apparatus 100, but provides, for example, various control signals for the inventive readout apparatus 100, so that the signal generator is only illustrated for explanatory purposes of the functioning of the inventive readout apparatus 100 in the various embodiments in FIG. 1 and in the further figures. The control signals $S_0$ and/or $S'_0$ can be generated or provided (internally or externally) in arbitrary manner.

As illustrated in FIG. 1, the sensor arrangement 110 is connected with its output terminal 110*b* to the input terminal 130*a* of the loop filter. The output terminal 130*b* of the loop filter 130 is connected to the input terminal 150*a* of the sample-quantizer 150. The output terminal 150*b* of the sample-quantizer 150 is connected to the first input terminal 170*a* of the feedback means 170. The first output terminal 190*a* of the signal generator 190 is connected to the input terminal 110*a* of the sensor arrangement 110. The second output terminal 190*b* of the signal generator 190 (optionally) is connected to the second input terminal 170*b* of the feedback means 170. The second output terminal 170*d* of the feedback means 170 is connected to the input terminal 130*a* of the loop filter 130 via the feedback branch 170-2.

In the following, the functioning of the inventive readout apparatus 100 illustrated in FIG. 1 will now be explained in detail, wherein how the analog sensor output signal $S_{sensor}$ of the sensor 110 provided at the output terminal 110*b* is obtained.

As illustrated in FIG. 1, the signal generator 190 is provided so as to provide a stimulation signal or carrier signal $S_0$ at the fundamental frequency $f_0$. This stimulation signal $S_0$ is now coupled into the sensor arrangement 110, so that the sensor output signal $S_{sensor}$ has the stimulation signal $S_0$ as so-called carrier signal, wherein the measured quantity 112, e.g., a pressure change or a vibration etc., induces a capacitance change $\Delta C$ of the sensor capacitance $C_{sensor}$ of the sensor arrangement 110. The stimulation signal $S_0$ generally is an electric alternating signal, such as a sinusoidal alternating voltage, oscillating at the fundamental frequency $f_0$. The sensor arrangement 110, advantageously formed as a capacitive sensor, comprises a sensor capacitance C dependent on the measured quantity 112 and determining a current I flowing through the sensor arrangement 110. The current I developing through the alternating signal $S_0$ is given by the relationship C*dU/dt (with dU/dt=temporal derivative of the voltage U), wherein the measured quantity 112 is superimposed or modulated onto the sensor output signal $S_{sensor}$ provided with the stimulation frequency $f_0$ via the resulting change in capacitance $\Delta C$.

The analog sensor output signal $S_{sensor}$ now present is supplied to the time-continuous loop filter 130. The loop filter 130, for example, is formed as a one-stage or also as a multi-stage band-pass filter with a center frequency with reference to the fundamental frequency $f_0$ of the stimulation signal $S_0$. With respect to the loop filter, it is to be noted that it may, however, also be formed as an analog or corresponding digital integrator in the simplest case, wherein it is to be noted in the design of the filter that the loop filter has extremely good pass behavior and/or high amplification for signals within the range of the stimulation frequency $f_0$.

The loop filter 130 for filtering the sensor output signal can be formed, corresponding to the inventive embodiments, so as to provide a filtered sensor output signal $S_{BP}$ in which frequency and/or spectral proportions present in a frequency range $\Delta f$ with respect to the fundamental frequency $f_0$ are amplified. The loop filter may, for example, comprise a resonator with at least a resonance at the frequency of the stimulation signal $S_0$, i.e. at the fundamental frequency $f_0$. The frequency range $\Delta f$ of the resonance(es) is disposed around the fundamental frequency, or there may also be several frequency ranges $\Delta f_i$ (of several resonances) arranged around the fundamental frequency $f_0$ in addition or as an alternative to the frequency range $\Delta f$. The loop filter 130, for example, comprises a resonator arrangement comprising a fundamental resonance at the fundamental frequency $f_0$ or several resonances (distributed around the fundamental frequency $f_0$) in addition to or as an alternative to the fundamental resonance. As it will still be explained in the following, this allows for improved noise filtering in a wide spectral range.

The width of the frequency range $\Delta f$ or the frequency ranges $\Delta f_i$ (with respect to the 3 dB cut-off frequency of the band-pass or the band amplification) depends, among other things, on the quality of the resonators used, and for example ranges from ±50% to ±0.1%, from ±20% to ±1%, or is at about ±5% with respect to the fundamental frequency $f_0$. The fundamental frequency $f_0$, for example, ranges from about 1 to about 200 kHz or about 5 to about 20 kHz.

The filtered (band-pass-filtered or band-amplified) analog output signal $S_{BP}$ ($S_{band\text{-}pass}$) of the loop filter 130 now is supplied to the sample-quantizer 150.

The sample-quantizer 150 has the task of generating, from the filtered, time and value-continuous sensor output signal $S_{BP}$, a digital and/or quantized (time and value-discrete) output signal $S_{quant}$. Here, the filtered sensor output signal $S_{BP}$ at first usually is sampled by means of a sample&hold circuit, in order to generate a time-discrete, value-continuous signal with sample&hold values from the time and value-continuous, filtered sensor output signal. This sample&hold signal then is converted into a digital n-bit word by an n-bit quantizer 150. The sample-quantizer 150 illustrated in FIG. 1 thus substantially performs the function of an analog/digital converter.

In the simplest case, the sample-quantizer 150, however, performs a one-bit quantization, i.e., a threshold decision of the band-pass-filtered sensor output signal $S_{BP}$ with respect to a comparison value is performed, wherein the output signal comprises complementary logical states corresponding to the threshold value decision for values falling below the threshold value and for values exceeding the threshold value each after a one-bit quantization process, e.g., a logical "1" value if the threshold is exceeded, and a logical "0" value if the threshold is not reached (or vice versa). In a n-bit quantizer with n greater than 1 (n>; n=2, 3, . . . ), accordingly, a quantization with respect to n thresholds is performed, wherein the output signal of the sample-quantizer 150 then represents an n-bit data word.

The present quantized sensor output signal $S_{quant}$ now is supplied to the feedback means 170. The feedback means 170 is provided so as to render the quantized sensor output signal $S_{quant}$ and to combine a time-continuous feedback signal $S_{feedback}$ with the analog sensor output signal $S_{sensor}$ at the input terminal 130*a* of the loop filter 130 or at a combination location between the output terminal 110*b* of the sensor arrangement 110 and the input terminal 130*a* of the loop filter 130. The feedback signal $S_{feedback}$ advantageously is a signal that is digital/analog converted from the quantized sensor output signal $S_{quant}$ (n-bit D/A conversion) and inverted. The feedback means 170 thus forms, together with the associated signal processing means 170-1 and with the associated feedback branch 170-2, the feedback loop of the inventive sensor readout apparatus 100 implemented as delta/sigma modulator. The output signal $S_{out}$ at the first output terminal 170*c* of the feedback means 170 represents the output signal of the inventive readout apparatus 100.

The delta/sigma converter loop shows a feedback path 170-2 to the input of the loop filter 130 in FIG. 1. With respect to an embodiment of the present invention, however, it is to be noted that further feedback paths 170-3 may also exist optionally, which can be fed or coupled into the loop filter 130 at various locations or stages if the loop filter 130 is formed to be multi-stage. With this, a cascaded delta/sigma modulator (delta/sigma modulator of higher order or with multiple feedback) can be realized.

As it becomes apparent from the embodiments of the present invention, the output signal $S_{out}$, for example, directly may be the quantized sensor output signal $S_{quant}$, wherein the output signal also may be a quantized sensor output signal $S_{demod}$ ($S'_{out}$) demodulated with respect to the fundamental frequency $f_0$.

In any case, the output signal $S_{out}$ is related to the sensor output signal $S_{sensor}$ in that the mean value of the output signal $S_{out}$ or the low-pass-filtered output signal $S_{out}$ of the delta/sigma modulator 100 illustrated in FIG. 1 corresponds to the sensor output signal $S_{sensor}$ of the sensor arrangement 110.

With respect to the readout apparatus 100 illustrated in FIG. 1 for a capacitive sensor 110, however, it is to be noted that the feedback means may further comprise a demodulator means (not shown in FIG. 1), which can demodulate the quantized sensor output signal $S_{quant}$ provided from the sample-quantizer 150, using the carrier signal $S_0$ with the fundamental frequency $f_0$ provided from the signal generator 190, in order to provide the output signal $S_{out}$, only dependent on the measured quantity, at the output terminal 170*c* to the inventive sensor readout apparatus. In this case, however, it is necessary that the carrier signal $S_0$ again be inserted into the feedback signal $S_{feedback}$ by means of the signal rendering means 170-1 associated with the feedback means 170, before the feedback signal $S_{feedback}$ is combined with the sensor output signal $S_{sensor}$ at the output of the loop filter 130.

The sensor readout apparatus illustrated in FIG. 1 for reading out an analog sensor output signal, modulated with a fundamental frequency $f_0$, of a capacitive sensor element 110 thus may convert an arbitrary, band-limited analog sensor output signal $S_{sensor}$ into an arbitrary n-bit output signal $S_{out}$ (or $S_{quant}$), wherein the sensor output signal $S_{sensor}$ can be recovered from the output signal $S_{out}$ by simple low-pass filtering (mean value formation), for example.

The sample-quantizer 150 illustrated in FIG. 1, for example, is formed as an "oversampled" A/D converter, i.e., the inventive sensor readout apparatus 100 formed as delta/sigma modulator is clocked at a frequency very much higher than the maximum frequency of the useful signal, i.e., of the sensor output signal $S_{sensor}$, wherein an oversampling by at least a factor of about 32 is used, for example. The output signal $S_{out}$ (or $S_{quant}$) is now negatively fed back to the input of the readout apparatus 100, i.e., to the $S_{out}$ 130*a* of the loop filter 130. If the loop amplification of the feedback path (feedback means 170 with feedback signal processing means 170-1) is sufficiently large, the output signal $S_{out}$ will follow the sensor output signal $S_{sensor}$, and hence the difference (or the error) $\Delta = S_{sensor} - S_{feedback}$ will be very small. The feedback loop suppresses the quantization and sampling noise of the sample-quantizer 150 by the large amplification of the loop filter 130 in the useful band, i.e., in the range around the fundamental frequency $f_0$. At higher frequencies, the loop amplification is low, which leads to the noise not being suppressed at these higher frequencies.

In the sensor readout apparatus 100 according to an embodiment of the invention, the sampling (sample&hold process) does not take place until directly before the quantizer, as this is illustrated by the functional block "sample-quantizer" 150 in the embodiments illustrated in FIG. 1. Thus, the filtered or band-pass-filtered sensor output signal $S_{BP}$ is sampled within the delta/sigma modulator loop 100.

As a result, the noise contained in the sensor output signal $S_{sensor}$ (quantization noise and white noise or sampling noise) is shaped and/or reshaped (noise shaping), i.e., shifted to high frequencies from the base band. Otherwise, the sensor output signal $S_{sensor}$ of the readout apparatus 100 formed as delta/sigma modulator remains unchanged. The sensor readout apparatus 100 according to the invention thus realizes a band-pass delta/sigma modulator working time-continuously for analog output signals of sensors and particularly capacitive sensors.

In the sensor readout apparatus according to an embodiment of the invention, thus the sampling no longer takes place at the sensor input, as this is the case in the known SC sensors, but not until within the delta/sigma modulator loop before the quantizer i.e., in a way in the A/D conversion of the filtered sensor output signal $S_{BP}$ within the delta/sigma modulator. Thus, the undesired sampling noise with the undesired noise proportions (white noise) is not induced until within the delta/sigma modulator loop, so that both this sampling noise (white noise) and the quantization noise are shifted to (higher) frequency ranges outside the relevant signal range around the stimulation frequency $f_0$ by the noise-shaping functionality of the inventive sensor readout apparatus 100 formed as delta/sigma modulator loop.

Thus, by the readout apparatus 100 according to an embodiment of the invention, the noise proportions due to the quantization noise as well as due to the white noise (sampling noise) for an analog sensor output signal $S_{sensor}$, modulated with a fundamental frequency $f_0$, of a capacitive sensor 110 can be suppressed extremely strongly, so that the achievable resolution of the sensor output signal $S_{sensor}$ to be sensed can be increased substantially as opposed to conventional procedures with SC technology.

With reference to the sensor readout apparatus illustrated in FIG. 1, it is to be noted that the signal noise behavior (SNR=signal noise ratio) may, for example, be improved further by the following measures.

Higher-order multi-stage filter arrangements or also resonators with high quality can be used for realizing the loop filter. The quantization process of the quantizer (sample-quantizer) can be performed with several bits. Furthermore, a cascaded delta/sigma modulator (higher-order delta/sigma modulator) can be used.

Figure 2:
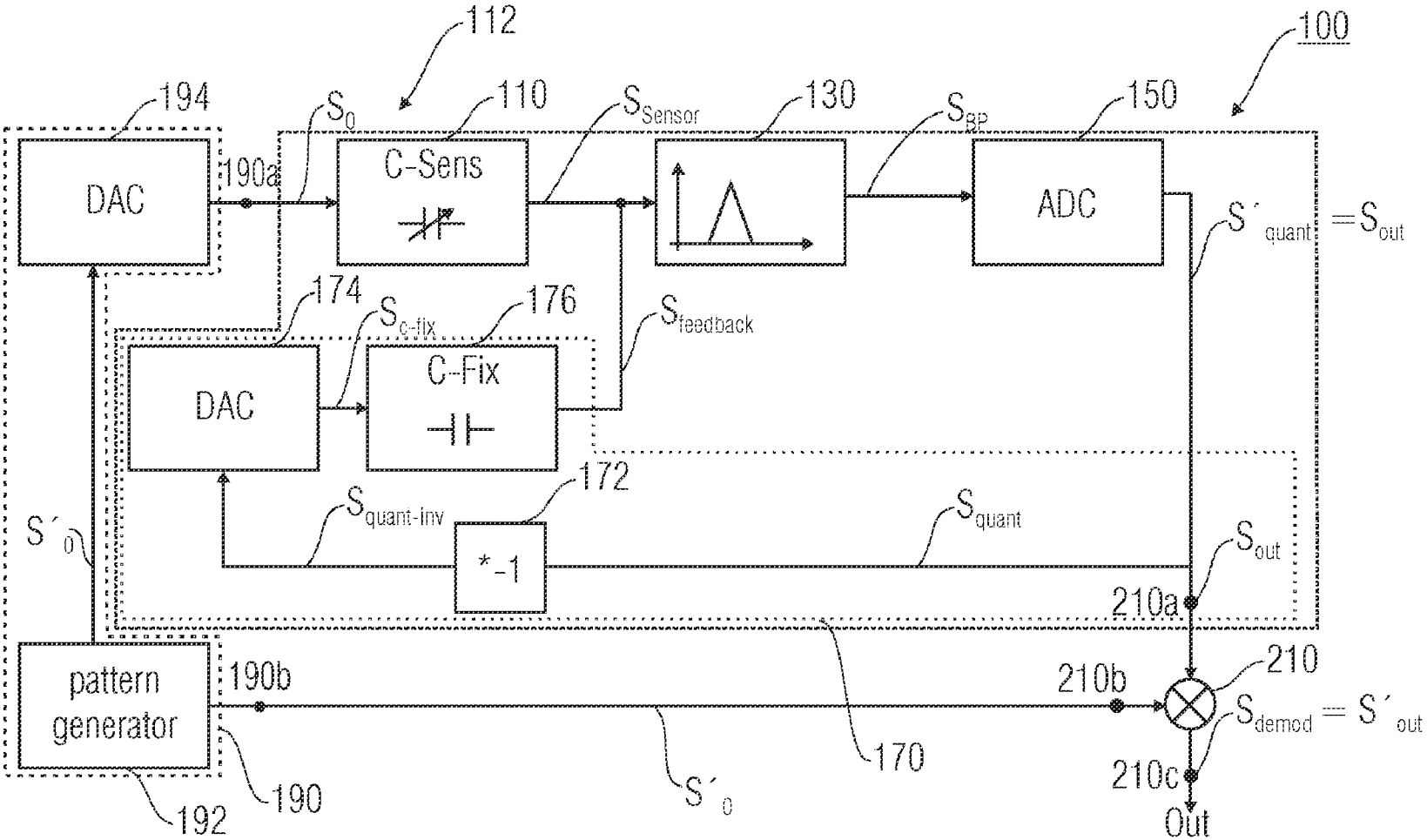
FIG. 2 is a principle illustration of a readout apparatus according to a further embodiment of the present invention.

FIG. 2 shows a further embodiment of the inventive apparatus 100 for reading out an analog sensor output signal, modulated with a fundamental frequency $f_0$, of a capacitive sensor.

Furthermore, in FIG. 2, the principle functional blocks are illustrated with respect to the readout apparatus 100, the sensor arrangement 110, the loop filter 130, the sample-quantizer 150, the feedback means 170 and the signal generator 190 and designated with the corresponding reference numerals.

As can be seen in the embodiment illustrated in FIG. 2, the feedback means 170 of the inventive readout apparatus 100 comprises an inverter 172, a digital/analog converter 174 and a reference capacitor 176. The signal generator 190 comprises a pattern generator 192 and a digital/analog converter 194. Furthermore, the feedback means 170 has a downstream demodulator 210, wherein it can be seen from FIG. 2 that the time-discrete, quantized sampling signal $S_{quant}$ output from the sample-quantizer 150 is passed from the feedback means 170 through to a first input 210*a* of the demodulator 210. Hence, the quantized signal $S_{quant}$ corresponds to the output signal $S_{out}$ of the inventive readout apparatus 100. Furthermore, the second output 190*b* of the signal generator 190 is connected to the second input terminal 210*b* of the modulator 210. The output terminal 210*c* of the demodulator 210 provides a demodulated output signal $S_{demod}$ (=$S'_{out}$).

In the following, now the functioning of the further embodiment of a sensor readout apparatus 100 according to the invention illustrated in FIG. 2 will be explained, wherein it will, however, be gone into the functional elements illustrated in addition to or deviating from FIG. 1, above all.

As illustrated in FIG. 2, the signal generator 190, for example, comprises a digital pattern generator 192, which provides a digital basic signal $S_0'$, which is converted to the analog stimulation signal $S_0$ with the fundamental frequency $f_0$ by the associated digital/analog converter 194, for impression into the sensor capacitor. The pattern signal $S_0'$ generated by the pattern generator may, for example, be a sinusoidal or also a square signal. The corresponding digital pattern signal $S_0'$ is provided at the second output 190*b* of the signal generator 190 and provided to the demodulator 210 as demodulation signal for demodulating the quantized sensor output signal $S_{quant}$ (=$S_{out}$).

As can be seen from FIG. 2, the feedback means 170 is formed so as to forward the quantized sensor output signal $S_{quant}$ in an unchanged manner to the first input terminal 210*a* of the demodulator 210 on the one hand, wherein the feedback means 170 further comprises, in the feedback branch, the inverter 172 for inverting the quantized sensor output signal $S_{quant}$ and a digital/analog converter 174 for converting the inverted quantized sensor output signal $S'_{quant}$ to an analog control signal for the reference capacitor 176. The feedback signal $S_{feedback}$ results from the application of the analog control signal $S_{C-fix}$ to the reference capacitor 176.

As can be seen from FIG. 2, both the sensor capacitor 110 and the reference capacitor 176, which functions as a feedback capacitor, each are imparted with an analog output signal or an analog output voltage of a digital/analog converter 174 and 194, respectively. The digital signal $S_0$ for the control of the digital/analog converter 194 for the sensor capacitor 110 is generated by the digital pattern generator 192, wherein the digital signal may be a sinusoidal or square signal. The control signal for the digital/analog converter 174 in the reference of a feedback branch is fed back from the sample-quantizer output 150*b* and rendered by the feedback means 170, i.e., by the inverter 172, the digital/analog converter 174 and the feedback capacitor 176, in order to generate the feedback signal $S_{feedback}$.

The delta/sigma converter loop only shows a feedback path to the input of the loop filter 130 in FIG. 2. With respect to the present invention, however, it is to be noted that further feedback paths (not shown in FIGS. 2-4) also may exist optionally, which paths can be fed or coupled into the loop filter 130 at various locations or stages if the loop filter 130 is formed to be multi-stage.

The output signal $S_{out}$ of the sensor signal readout apparatus 100 according to the invention, present in the form of the quantized sensor output signal $S_{quant}$ in the embodiment of FIG. 2, now is demodulated with the aid of the stimulation pattern $S'_0$ generated by the pattern generator 192, which is provided at the output 190*b* as output signal $S'_0$ of the signal generator 190.

According to the embodiments of the present signal readout apparatus according to the invention, the two digital/analog converters 174 and 194, and also optional digital/analog converters for additional, optional feedback paths, use the same reference voltage, so that this reference voltage is reduced out of the delta/sigma conversion function (signal transmission function) of the signal readout apparatus 100 realized as a delta/sigma modulator.

With respect to the inverter 172, illustrated separately in the feedback path, and the digital/analog converter 174, it should of course become obvious that these may of course also be combined into one (digital) functional unit.

The feedback or reference capacitor 176 ($C_{fix}$) in the feedback loop may, for example, be formed so as to eliminate spurious influences on the capacitance value of the sensor capacitor 110, which do not go back to the measured quantity and also act on the fixed reference capacitor 176, by the combination of the sensor output signal $S_{sensor}$ with the feedback signal $S_{feedback}$. Such influences may, for example, be caused due to temperature variations or any other undesired spurious influences acting both on the sensor capacitor 110 and the reference capacitor 176.

Figure 3:
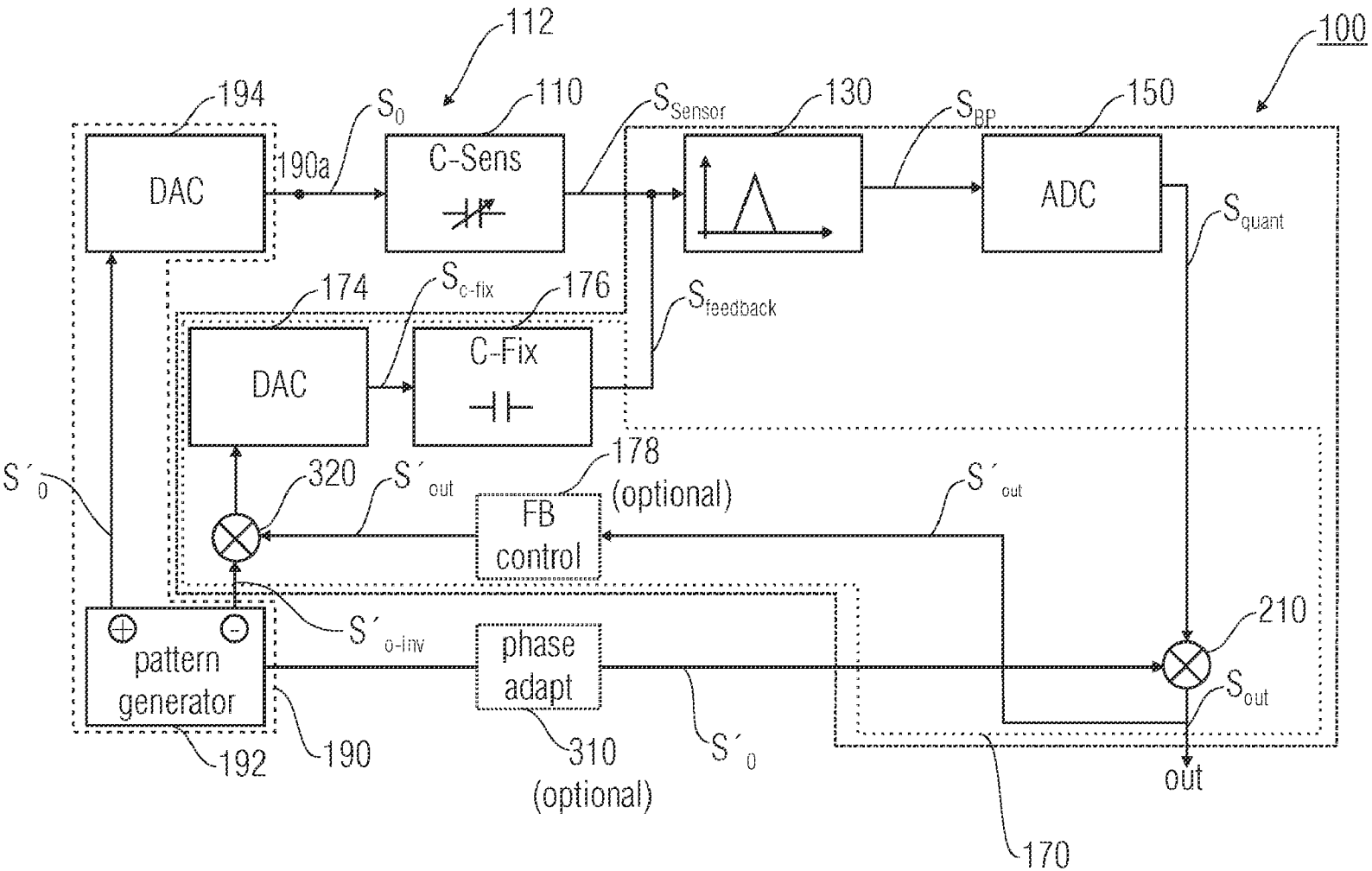
FIG. 3 is a principle illustration of a readout apparatus according to a further embodiment of the present invention.

FIG. 3 shows a further embodiment of the inventive sensor signal readout apparatus 100. In the following, the functioning of the inventive sensor readout apparatus 100 illustrated in FIG. 3 will now be explained, wherein the functional elements illustrated in addition to or deviating from FIG. 1 or 2, will be shown.

As illustrated in FIG. 3, the feedback means 170 comprises the demodulator 210, i.e., the demodulator 210 is associated with the feedback means 170, wherein the feedback path is tapped downstream to the demodulator 210 in the feedback means 170. The feedback path of the feedback means 170 further comprises an optional feedback control means 178 (feedback control) and a further combination means or modulator 320. Furthermore, an optional phase adaptation means 310 (phase adapt) is provided between the output terminal 190*b* of the signal generator 190 and the second input terminal 210*b* of the demodulator 210. Furthermore, the pattern generator 192 of the signal generator 190 is formed so as to supply the modulator 320 with an inverted signal generator signal $S'_{0-inv}$. The output signal of the demodulator 320, which is based on the demodulated output signal $S_{out}$ (optionally with feedback control) and the inverted generator signal $S'_{0-inv}$, is supplied to the digital/analog converter 174.

In the inventive embodiment illustrated in FIG. 3, the control signal $S_{C-fix}$ or the control for the digital/analog converter (feedback DAC) is not directly fed back from the quantized sensor output signal $S_{quant}$ of the sample-quantizer 150 in the feedback loop of the delta/sigma modulator 100, but generated synchronously with the control signal $S_0'$ of the sensor branch as inverted control signal $S'_{0-inv}$. For the feedback, in the embodiment illustrated in FIG. 3, the output signal $S_{demod}$ (=$S'_{out}$) demodulated by the demodulator 210 is used for the modulation of the amplitude, i.e., for the generation of the feedback signal $S_{feedback}$. In this embodiment, the signal $S'_{out}$ ($S_{demod}$) thus represents the output signal of the sensor signal readout apparatus 100.

Optionally to the optional feedback control means 178, a regulator, e.g., a PI regulator, or further filter means can be introduced into the feedback path to change the regulating properties of the delta/sigma modulator loop of the inventive sensor signal readout apparatus 100, in order to obtain increased phase reserve, for example. Since the feedback loop 170 of the delta/sigma modulator does no longer necessarily synchronize the phase of the output signal correctly in the arrangement illustrated in FIG. 3, now the control signal $S'_0$ of the pattern generator 192 supplied to the output, i.e., the demodulator 210, for demodulation can be adapted to the phase location of the sample-quantizer 150 with the aid of an optional, additional filter 310 (phase adaptation means).

Otherwise, the embodiment of FIG. 3 substantially has the same functionality as the embodiments described on the basis of FIG. 1 or 2.

Figure 4:
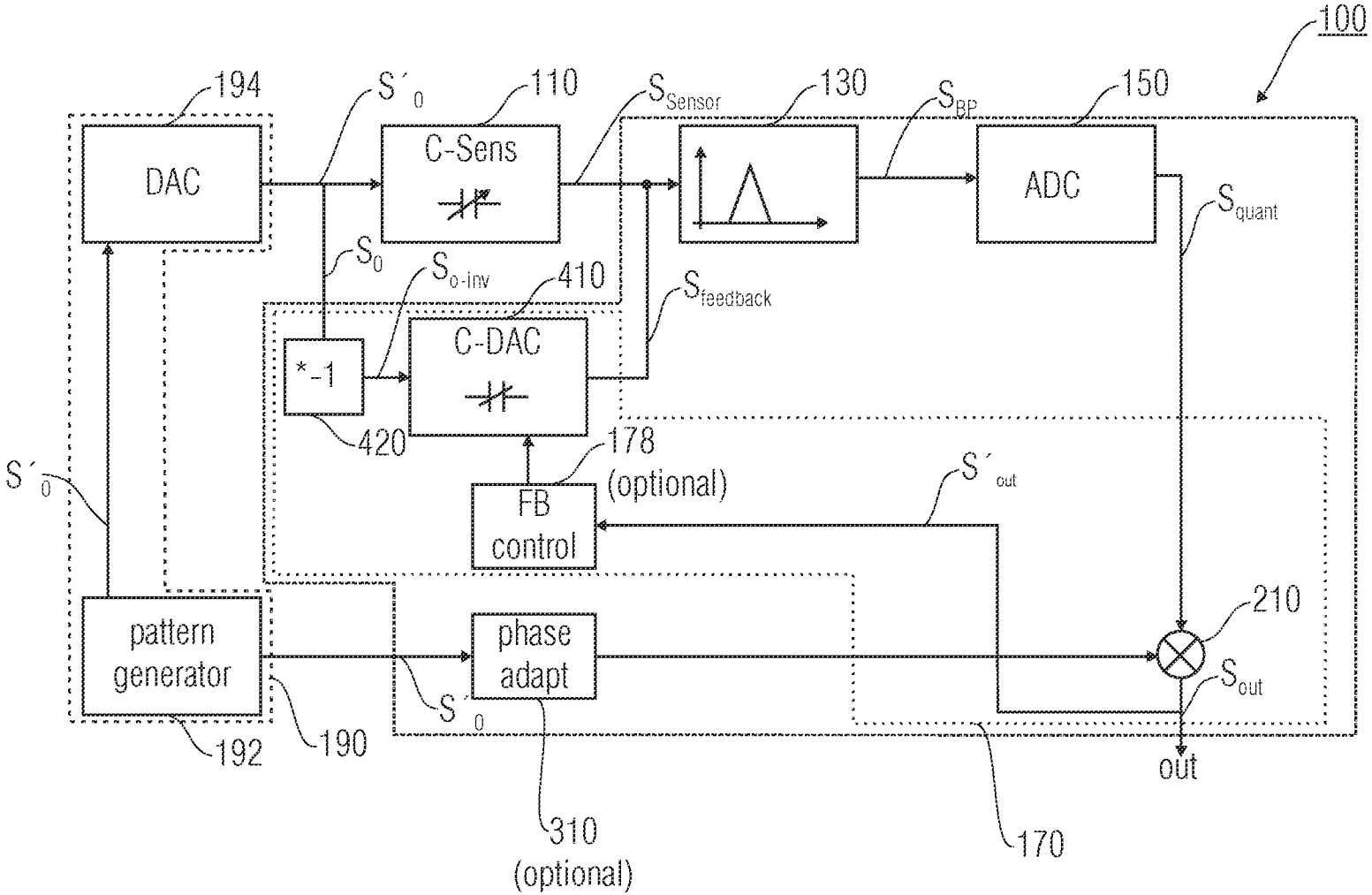
FIG. 4 is a principle illustration of a readout apparatus according to a further embodiment of the present invention.

In FIG. 4, now a further embodiment of the sensor signal readout apparatus 100 according to the invention is illustrated. In the embodiment illustrated in FIG. 4, the signal generator 190 is now again illustrated with the pattern generator 192 and the digital/analog converter 194 (see FIG. 2), wherein substantially only the feedback signal processing means 170-1 of the feedback means 170 of FIG. 4 is formed differently with respect to the previous embodiment of FIG. 3.

In the embodiment illustrated in FIG. 4, the feedback path again starts at the output of the demodulator 210, wherein the output signal $S_{demod}$ is supplied to a feedback capacitor 410 via an optional feedback control means 178 (feedback control). The feedback capacitor 410 is further supplied with the control signal $S_{0-inv}$ inverted by an inverter means 420. The output signal of the feedback capacitor again represents the feedback signal $S_{feedback}$ for combination with the sensor output signal $S_{sensor}$ at the input 130*a* of the loop filter 130.

In the further embodiment illustrated in FIG. 4, it is not the input voltage, but the reference capacitance in the feedback branch that is used for the generation of the feedback in the delta/sigma modulator.

Here, also further regulators, such as a PI regulator, or also other filters may optionally be introduced into the feedback path formed by the feedback means 170.

Otherwise, the embodiment of FIG. 4 substantially has the same functionality as the embodiments described on the basis of FIG. 1, 2 or 3.

With respect to the embodiments previously described on the basis of FIGS. 1 to 4, it should become obvious that the feedback branch should, on average, provide the signal (current) opposite to the input branch. To this end, according to the invention, it is possible that the signal is determined by the derivative of the stimulation signal and the input capacitor. So as to then generate an equal signal in the feedback branch, according to the invention, a fixed reference capacitor is used, for example, in order to then regulate the input voltage (e.g., the sensor signal) so that it is 180°-phase-shifted and scaled with $C_{sensor}/C_{Fix}$ (or $C_{sensor}/C_{DAC}$) in the amplitude.

The other possibility according to an embodiment of the invention, so that the feedback branch, on average, provides the signal opposite to the input branch, consists in the fact that the above-mentioned amplitude can be kept constant and the signal amplitudes are compensated or corrected or regulated by using a capacitor (reference capacitor or sensor capacitor) that can be increased or decreased by adding and removing partial capacitances.

Furthermore, with reference to the embodiments of the present invention illustrated previously, it is to be noted that the reference capacitance can be put to the input and the sensor capacitance into the feedback, i.e., the sensor capacitance $C_{sensor}$ and the reference capacitance $C_{Fix}$ or $C_{DAC}$ can be exchanged with respect to the arrangement illustrated in FIGS. 1 to 4. As a result, the regulator output, which tracks the feedback voltage, then is inversely proportional to the sensor capacitance.

The previously described embodiments have above, all been explained with respect to capacitive sensors. Embodiments of the present invention, however, substantially are applicable to all sensors providing an analog output signal, and particularly with such sensors with an analog output signal in which the achievable resolution of the measurement signal (sensor output signal) is limited by white noise in readout processes.

In particular, it is pointed out that, depending on the conditions, the inventive scheme may also be implemented in software. The implementation may be on a digital storage medium, particularly a floppy disk or a CD with electronically readable control signals capable of cooperating with a programmable computer system so that the corresponding method is executed. In general, the invention thus also consists in a computer program product with a program code stored on a machine-readable carrier for performing the inventive method when the computer program product is executed on a computer. In other words, the invention may thus also be realized as a computer program with a program code for performing the method, when the computer program is executed on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

What is claimed is:

1. An apparatus for reading out an analog sensor output signal, of a sensor, modulated with a fundamental frequency $f_0$, the apparatus comprising:

a loop filter for filtering the analog sensor output signal that is modulated with the fundamental frequency $f_0$ and is combined with a feedback signal to provide a filtered analog sensor output signal in which frequency proportions present in a frequency range $\Delta f$ with respect to the fundamental frequency $f_0$ are amplified;

a sample-quantizer for sampling and quantizing the filtered analog sensor output signal to provide a time-discrete, quantized sensor output signal; and a feedback circuit for feeding the feedback signal based on the time-discrete, quantized sensor output signal back to the loop filter and for providing a readout signal, wherein the readout signal corresponds to the time-discrete, quantized sensor output signal or a time-discrete, quantized sensor output signal demodulated with respect to the fundamental frequency $f_0$.

2. The apparatus according to claim 1, wherein the loop filter comprises a time-continuous filter.

3. The apparatus according to claim 1, wherein the frequency range $\Delta f$ is arranged around the fundamental frequency $f_0$, or wherein several frequency ranges $\Delta fi$ are arranged around the fundamental frequency $f_0$ in addition to or alternatively to the frequency range $\Delta f$.

4. The apparatus according to claim 1, wherein the loop filter comprises a resonator comprising a basic resonance at the fundamental frequency $f_0$ or several resonances around the fundamental frequency $f_0$ in addition to or alternatively to the basic resonance.

5. The apparatus according to claim 1, wherein the feedback circuit provides a feedback branch to an input of the loop filter and comprises a feedback signal renderer.

6. The apparatus according to claim 5, wherein the feedback signal renderer comprises an n-bit digital/analog converter and/or an inverter.

7. The apparatus according to claim 5, wherein the sensor comprises a capacitive sensor with a sensor capacitor, wherein the feedback signal renderer comprises a reference capacitor or a sensor capacitor.

8. The apparatus according to claim 1, wherein the feedback circuit comprises a demodulator for demodulating the time-discrete, quantized sensor output signal with the fundamental frequency $f_0$, the demodulator being connected downstream of the sample-quantizer, in order to obtain the demodulated, time-discrete quantized sensor output signal.

9. The apparatus according to claim 1, wherein the feedback signal fed from a feedback branch back to the loop filter is based on the time-discrete, quantized sensor output signal provided from the sample-quantizer or on the demodulated time-discrete, sensor output signal provided from a demodulator.

10. The apparatus according to claim 9, further comprising a feedback signal renderer in the feedback branch , the feedback signal renderer comprises a regulator or an additional filter to adjust a feedback property of the feedback branch with respect to phase, frequency, or amplitude.

11. The apparatus according to claim 1, wherein the sample-quantizer comprises a sample-and-hold arrangement and an n-bit quantizer, with n equal to or greater than 1, in order to sample and quantize the filtered sensor output signal with respect to n bits, to provide a time-discrete, n-bit-quantized sensor output signal.

12. The apparatus according to claim 1, wherein the loop filter comprises a higher-order filter with a plurality of stages.

13. The apparatus according to claim 12, wherein the loop filter comprises at least one further input associated with one of the plurality of stages of the loop filter for the feedback signal or a further feedback signal.

14. The apparatus according to claim 13, wherein the feedback circuit comprises a further feedback branch for the further feedback signal, wherein the further feedback branch with the further feedback signal is fed back to the further input of the at least one further stage of the loop filter.

15. The apparatus according to claim 14, wherein the further feedback branch comprises a further feedback signal renderer, wherein the further feedback signal renderer comprises a further n-bit digital/analog converter, a further reference capacitor, and/or a further inverter.

16. An apparatus for reading out an analog sensor output signal of a capacitive sensor, modulated with a fundamental frequency $f_0$, the apparatus comprising:

loop filter means with an input terminal and an output terminal, the loop filter means for filtering the analog sensor output signal present at its input terminal that is modulated with the fundamental frequency $f_0$ and is combined with a feedback signal, in order to provide, at its output terminal, a filtered analog sensor output signal in which frequency proportions present in a frequency range $\Delta f$ around the fundamental frequency $f_0$ are amplified;

sampling and quantizing means with an input terminal and an output terminal, the sampling and quantizing means for sampling and quantizing the filtered analog sensor output signal present at its input terminal, in order to provide, at its output terminal, a time-discrete, quantized sensor output signal; and feedback means with an input terminal and first and second output terminals, the feedback means for providing a time-continuous feedback signal, which is based on the time-discrete, quantized sensor output signal present at its input terminal, to its first output terminal, which is connected to the input terminal of the loop filter means, and the feedback means providing, at its second output terminal, a readout signal, which based on the time-discrete, quantized sensor output signal or a time-discrete, quantized sensor output signal demodulated with respect to the fundamental. frequency $f_0$.

17. The apparatus according to claim 16, wherein the frequency range $\Delta f$ is arranged around the fundamental frequency $f_0$, or wherein several frequency ranges $\Delta f_i$ are arranged around the fundamental frequency $f_0$ in addition to or alternatively to the frequency range $\Delta f$.

18. The apparatus according to claim 16, wherein the feedback means provides a feedback branch to the input of the loop filter and comprises a feedback signal rendering means.

19. The apparatus according to claim 18, wherein the feedback signal rendering means comprises an n-bit digital/analog converter, a reference capacitor, and/or an inverter.

20. The apparatus according to claim 16, wherein the feedback means comprises a demodulator means for demodulating the time-discrete, quantized sensor output signal with the fundamental frequency $f_0$, which is connected downstream of the sample and quantizing means, in order to obtain the demodulated, time-discrete quantized sensor output signal.

21. The apparatus according to claim 16, wherein the time-continuous feedback signal fed from a feedback branch back to the loop filter means is based on the time-discrete, quantized sensor output signal provided from the sample and quantizing means or on the demodulated time-discrete, quantized sensor output signal provided from demodulator means.

22. The apparatus according to claim 16, wherein the sample and quantizing means comprises a sample-and-hold arrangement and an n-bit quantizing means, with n equal to or greater than 1, in order to sample and quantize the filtered sensor output signal with respect to n bits, to provide a time-discrete, n-bit-quantized sensor output signal.

23. The apparatus according to claim 16, wherein the loop filter means comprises a time-continuous, higher-order filter with a plurality of stages.

24. The apparatus according to claim 23, wherein the feedback means comprises a further feedback branch with a further feedback signal rendering means, the further feedback signal rendering means comprising a further n-bit digital/analog converter, a further reference capacitor, and/or a further inverter, wherein the further feedback branch is fed back to an input of the at least one further stage of the loop filter means.

25. The apparatus according to claim 16, wherein the sensor is a capacitive sensor.

26. An apparatus for reading out an analog sensor output signal of a sensor, modulated with a fundamental frequency $f_0$, the apparatus comprising:

a loop filter for filtering the analog sensor output signal that is modulated with the fundamental frequency $f_0$ and is combined with a feedback signal to provide a filtered analog sensor output signal in which frequency proportions present in a frequency range Δf around the fundamental frequency $f_0$ are amplified;

a sample-quantizer for sampling and quantizing the filtered analog sensor output signal to provide a time-discrete, quantized sensor output signal; and a feedback circuit for feeding the feedback signal based on the time-discrete, quantized sensor output signal back to the loop filter and for providing a readout signal, wherein the readout signal corresponds to the time-discrete, quantized sensor output signal, wherein the feedback circuit provides a feedback branch to an input of the loop filter and comprises a feedback signal renderer, and wherein the feedback signal renderer comprises an n-bit digital/analog converter, a reference capacitor, and/or an inverter.

27. The apparatus according to claim 26, wherein the frequency range Δf is arranged around the fundamental frequency $f_0$, or wherein several frequency ranges $\Delta f_i$ are arranged around the fundamental frequency $f_0$ in addition to or alternatively to the frequency range Δf.

28. The apparatus according to claim 26, wherein the sample-quantizer comprises a sample-and-hold arrangement and an n-bit quantizer, with n equal to or greater than 1, in order to sample and quantize the filtered sensor output signal with respect to n bits, to provide a time-discrete, n-bit-quantized sensor output signal.

29. The apparatus according to claim 26, wherein the loop filter is a time-continuous higher-order filter with a plurality of stages.

30. The apparatus according to claim 26, wherein the feedback circuit comprises a further feedback branch with a further feedback signal renderer, the further feedback signal renderer comprising a further n-bit digital/analog converter, a further reference capacitor, and/or a further inverter, wherein the further feedback branch is fed back to an input of at least one further stage of the loop filter.

31. An apparatus for reading out an analog sensor output signal of a sensor, modulated with a fundamental frequency $f_0$, the apparatus comprising:

a loop filter for filtering the analog sensor output signal that is modulated with the fundamental frequency $f_0$ and is combined with a feedback signal to provide a filtered analog sensor output signal in which frequency proportions present in a frequency range Δf around the fundamental frequency $f_0$ are amplified;

a sample-quantizer for sampling and quantizing the filtered analog sensor output signal to provide a time-discrete, quantized sensor output signal; and a feedback circuit for feeding the feedback signal based on the time-discrete, quantized sensor output signal back to the loop filter and for providing a readout signal, wherein the readout signal corresponds to a time-discrete, quantized sensor output signal demodulated with respect to the fundamental frequency $f_0$, wherein the feedback circuit comprises a demodulator for demodulating the time-discrete, quantized sensor output signal with the fundamental frequency $f_0$, which is connected downstream of the sample-quantizer, in order to obtain the demodulated, time-discrete quantized sensor output signal.

32. The apparatus according to claim 31, wherein the frequency range Δf is arranged around the fundamental frequency $f_0$, or wherein several frequency ranges $\Delta f_i$ are arranged around the fundamental frequency $f_0$ in addition to or alternatively to the frequency range Δf.

33. The apparatus according to claim 31, wherein the feedback signal supplied from the feedback circuit to the loop filter is based on the demodulated time-discrete, quantized sensor output signal provided by the demodulator.

34. The apparatus according to claim 31, wherein the sample-quantizer comprises a sample-and-hold arrangement and an n-bit quantizer, with n equal to or greater than 1, in order to sample and quantize the filtered sensor signal with respect to n bits, to provide a time-discrete, n-bit-quantized sensor output signal.

35. The apparatus according to claim 31, wherein the loop filter is a time-continuous higher-order filter with a plurality of stages.

36. The apparatus according to claim 35, wherein the loop filter comprises at least one further input associated with one of the plurality of stages of the loop filter for the feedback signal or a further feedback signal.

37. The apparatus according to claim 36, wherein the feedback circuit comprises a further feedback branch, wherein the further feedback branch feeds the further feedback signal back to the further input of the at least one further stage of the loop filter.

38. A method for reading out an analog sensor output signal of a sensor, modulated with a fundamental frequency $f_0$, the method comprising:

filtering the analog sensor output signal, which is modulated with the fundamental frequency $f_0$ and is combined with a feedback signal, with a loop filter to provide a filtered analog sensor output signal in which frequency proportions present in a frequency range Δf around the fundamental frequency $f_0$ are amplified;

sampling and quantizing the filtered sensor output signal to provide a time-discrete, quantized sensor output signal; and feeding back the feedback signal based on the time-discrete, quantized sensor output signal to the loop filter and providing a readout signal, wherein the readout signal corresponds to the time-discrete, quantized sensor output signal or a time-discrete, quantized sensor output signal demodulated with respect to the fundamental frequency $f_0$.

39. The method according to claim 38, wherein a feedback signal rendering is performed in the feedback.

40. The method according to claim 39, wherein an n-bit digital/analog conversion, a signal application to a reference capacitor, and/or a signal inversion is performed in the feedback signal rendition.

41. The method according to claim 39, wherein a demodulation with the time-discrete, quantized sensor output signal with the fundamental frequency $f_0$ is performed in the feedback signal rendition, in order to obtain the demodulated, time-discrete, quantized sensor output signal.

42. The method according to claim 39, wherein a regulation or an additional filtering is further performed in the feedback signal rendition, in order to adjust feedback property with respect to phase, frequency, and/or amplitude.

43. The method according to claim 38, wherein the sampling and quantizing comprises a sample-and-hold operation and an n-bit-quantization, with n equal to or greater than 1, in order to sample and quantize the filtered sensor signal with respect to n bits, to provide a time-discrete n-bit quantized sensor output signal.

44. A method for reading out an analog sensor output signal of a sensor, modulated with a fundamental frequency $f_0$, the method comprising:

filtering the analog sensor output signal that is modulated with the fundamental frequency $f_0$ and is combined with a feedback signal to provide a filtered analog sensor output signal in which frequency proportions present in a frequency range Δf around the fundamental frequency $f_0$ are amplified;

sampling and quantizing the filtered analog sensor output signal to provide a time-discrete, quantized sensor output signal; and feeding back the feedback signal based on the time-discrete, quantized sensor output signal to a loop filter and providing a readout signal, wherein the readout signal corresponds to the time-discrete, quantized sensor output signal, wherein an n-bit digital/analog conversion, a signal application to a reference capacitor, and/or a signal inversion is performed in the feedback.

45. The method according to claim 44, wherein sampling and quantizing comprises a sample-and-hold operation and an n-bit quantization, with n equal to or greater than 1, in order to sample and quantize the filtered sensor signal with respect to n bits, to provide a time-discrete, n-bit quantized sensor output signal.

46. A non-transitory computer-readable storage medium with an executable computer program stored thereon, wherein the computer program is executed on a computer or microcontroller to perform a method for reading out an analog sensor output signal of a sensor, modulated with a fundamental frequency $f_0$, the method comprising:

filtering the analog sensor output signal, which is modulated with the fundamental frequency $f_0$ and is combined with a feedback signal, with a loop filter to provide a filtered analog sensor output signal in which frequency proportions present in a frequency range Δf around the fundamental frequency $f_0$ are amplified;

sampling and quantizing the filtered analog sensor output signal to provide a time-discrete, quantized sensor output signal; and feeding back the feedback signal based on the time-discrete, quantized sensor output signal to a loop filter and providing a readout signal, wherein the readout signal corresponds to the time-discrete, quantized sensor output signal or a time-discrete, quantized sensor output signal demodulated with respect to the fundamental frequency $f_0$.

47. A non-transitory computer-readable storage medium with an executable computer program stored thereon, wherein the computer program is executed on a computer or microcontroller to perform a method for reading out an analog sensor output signal of a sensor, modulated with a fundamental frequency $f_0$, the method comprising:

filtering the analog sensor output signal that is modulated with the fundamental frequency $f_0$ and is combined with a feedback signal to provide a filtered analog sensor output signal in which frequency proportions present in a frequency range Δf around the fundamental frequency $f_0$ are amplified;

sampling and quantizing the filtered sensor output signal to provide a time-discrete, quantized sensor output signal; and feeding back feedback signal based on the time-discrete, quantized sensor output signal to a loop filter and providing a readout signal, wherein the readout signal corresponds to the time-discrete, quantized sensor output signal, wherein an n-bit digital/analog conversion, a signal application to a reference capacitor, and/or a signal inversion is performed in the feedback.

* * * * *